United States Patent [19]

Tweed et al.

[11] 4,238,640

[45] Dec. 9, 1980

[54] ELECTRICAL CONNECTOR FOR HEATERS

[75] Inventors: Donald G. Tweed, Mountain View; Danny G. Morrow, La Honda, both of Calif.

[73] Assignee: Raychem Corporation, Menlo Park, Calif.

[21] Appl. No.: 6,186

[22] Filed: Jan. 24, 1979

[51] Int. Cl.[3] ..... H01R 4/18

[52] U.S. Cl. ..... 174/87; 174/76; 174/84 C; 219/541; 339/276 T

[58] Field of Search ..... 174/76, 84 C, 87, 94 R, 174/70 B, 70 C, 71 B; 219/541; 338/323, 332; 339/276 T, 276 SF; 403/278, 281, 285

[56] References Cited

U.S. PATENT DOCUMENTS

| | | | |
|---|---|---|---|
| 2,925,461 | 2/1960 | Anderson | 174/87 |
| 3,507,977 | 4/1970 | Pusey | 174/84 C |
| 4,039,742 | 8/1977 | Smith | 174/76 |

*Primary Examiner*—Roy N. Envall, Jr.
*Attorney, Agent, or Firm*—Lyon & Lyon

[57] ABSTRACT

An electrical connector which can be used for pipe line heaters includes a base, an insert having a slot therethrough for a conductor, and a crimp barrel for the insert. A cap fits over the barrel and cooperates with the barrel and base so that when the cap is filled with a viscous potting compound, and the cap is slid over the barrel, the potting compound is pressured so that it substantially completely fills the cap and the base, thereby environmentally sealing the resulting assembly.

27 Claims, 4 Drawing Figures

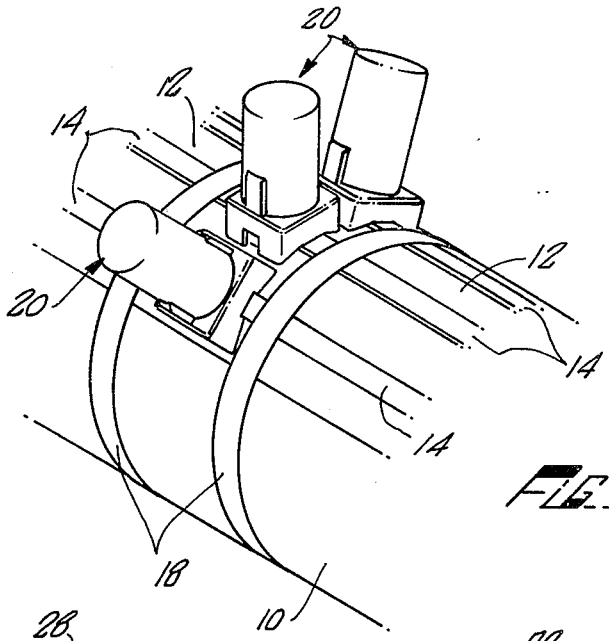
FIG. 1
FIG. 3
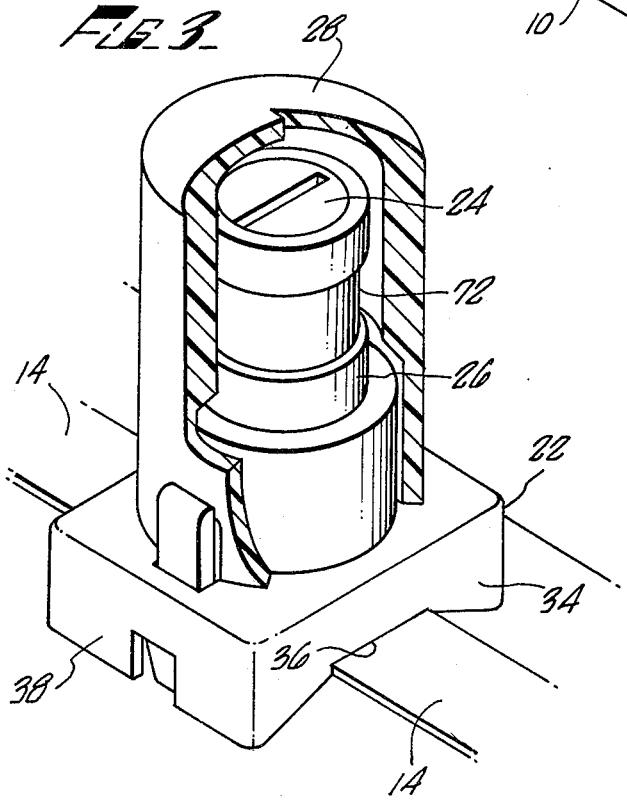
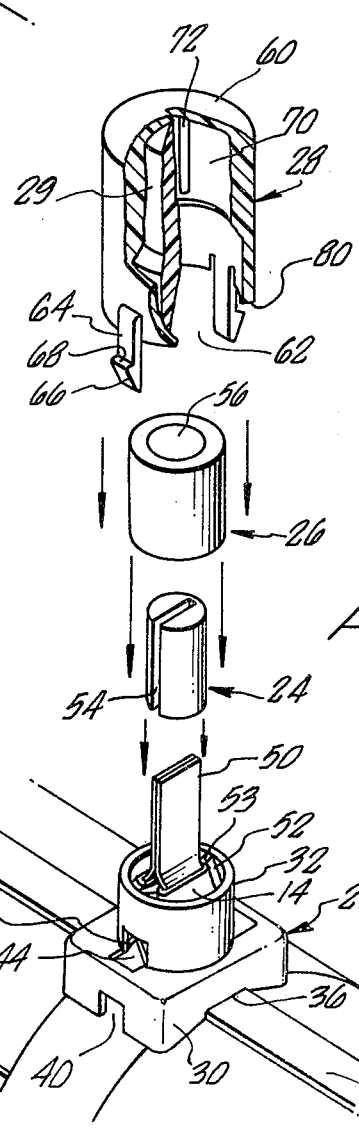
FIG. 2
FIG. 4
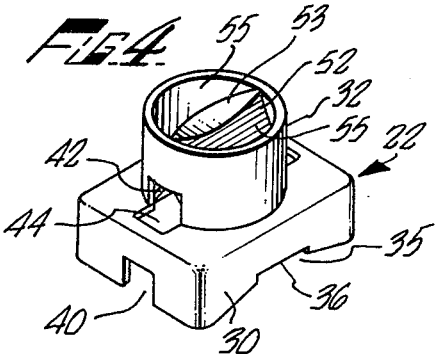

ELECTRICAL CONNECTOR FOR HEATERS

BACKGROUND

Heater strips for such applications as heat tracing pipes and vessels are well known. For example, U.S. Pat. No. 3,793,716 describes a heater strip comprising two conductive wires embedded in a positive temperature coefficient polymeric material. U.S. Pat. Application Ser. No. 938,591 filed on Aug. 31, 1978, which is incorporated herein by reference, describes a pipe line heating apparatus comprising three flat resistive elements or conductors that run in spaced apart parallel relation along the surface to be heated. These three conductors are surrounded by insulation and sandwiched between two flat strips of aluminum. This heater can be strapped to a pipeline in substantial conformity with the shape of the circumference and length of the pipeline. The flat aluminum strips serve to conduct and diffuse the heat generated by the three flat conductors over the surface of the pipeline.

Heaters are spliced together by electrically connecting each of the three conductors of each heater to a corresponding conductor of another heater. In addition, heaters such as those described in Application Ser. No. 938,591 can be electrically terminated by splicing the three conductors of one heater together. Heaters are also connected to a power source via their conductors.

Connecting apparatus are needed for effecting these connections. It is desirable that one type of apparatus be used for all types of connections, and the apparatus can be used for conductors of different sizes. It is also desirable that the apparatus provide a moisture-proof environment for the connection so that the heater can be used in areas where water vapor is present. The apparatus should provide a connection that remains unaffected by chemicals likely to be found in and around pipe lines and temperature cycling. In addition, the apparatus should be easy to use and inexpensive to manufacture.

SUMMARY

The present invention is directed to a connector with the above features, the resultant connection formed by the connector, and the simple technique by which the connector is used.

In its simplest form, the connector comprises a deformable insert and a deformable crimp barrel shaped to fit around the insert. The insert has at least one aperture adapted to receive the conductors to be connected. For flat conductors, the aperture can be a rectangular slot which extends through a circumferential edge along the entire length of the insert, the slot being sufficiently wide to accept at least two flat conductors of a heater. When the barrel is crimped around the insert, the insert deforms a substantial portion of the width of the aperture to hold conductors firmly therein to form a reliable electrical connection.

Preferably the connector also includes a base adapted for mounting on a support surface and a cap slideable over the barrel, the cap having an open end which seats against and attaches to the base. Preferably the base has an entrance hole in each of two opposing side walls for the conductors, mounting means for the cap on each of two other opposing side walls, and a support saddle adapted for holding the ends of the conductors away from the support surface and oriented substantially at right angles to the support surface for easy access. The cap has deflectable, barbed prongs adapted for engagement with the base. In use, the cap contains a sealant such that the sliding action of the cap pressures the sealant present in the cap substantially uniformly to completely fill the cap and the base. Preferably the cap has internal ribs projecting inwardly so that when the cap is slid over the barrel, the barrel is maintained substantially centrally located along the longitudinal axis of the cap to pressure the sealant uniformly. The sealant, in conjunction with the assembled cap and base, forms a water proof, mechanically rugged electrically nonconductive assembly that protects the conductors from the environment.

DRAWINGS

These and other features, aspects and advantages of the present invention will become better understood with reference to the following description, appended claims, and accompanying drawings where:

FIG. 1 shows two pipeline heaters, each having three substantially flat conductors, the conductor of each heater being spliced to a corresponding conductor of another heater by means of a connector according to the present invention;

FIG. 2 is an exploded perspective view of one of the connectors of FIG. 1 prior to assembly of the components of the connector;

FIG. 3 is a perspective view of the connector of FIG. 2 after assembly of the components, where a portion of the cap of the connector is cut away; and FIG. 4 is a perspective view of the base of the connector of FIG. 2.

DESCRIPTION

Although the following description is made in connection with a flat conductor pipeline heater, it is to be understood that the connector is easily adapted for electrically conductors used for different purposes and of a shape other than flat.

FIG. 1 shows a pipe 10 having mounted thereon two pipeline heating apparatus 12 such as those described in the aforementioned U.S. Patent Application Ser. No. 938,591. Each heater comprises three flat resistive elements 14 or conductors in spaced, parallel relation along the length of the pipe. These conductors are surrounded by insulation and each is sandwiched between two flat strips of aluminum. Each heater can be strapped to the pipeline by means of straps 18 extending circumferentially around the pipe 10. The heaters are strapped so that they are in substantial conformity with the shape of the circumference and length of the pipe 10. Each conductor 14 of each heater is spliced to the conductor of another heater by means of a connector 20 according to the present invention.

A connector of FIG. 1 is shown unassembled in FIG. 2 and is shown assembled in FIG. 3. Each assembled connector comprises a base 22, an insert 24, a tubular, deformable barrel 26, a cap 28, and sealant 29.

The base 22, which is of unitary construction, comprises a lower box-shaped portion 30 and a tubular portion 32 mounted thereon. The base is shaped for mounting on a variety of support surfaces including curved and flat surfaces. The base is able to conform to surfaces such as pipe surfaces because each of two opposing sidewalls 34 has a cut-a-away entrance hole portion 35, including a central section 36 cut away so that a flat conductor can fit snugly between the base and the pipe surface.

The other opposing sidewalls 38 of the box-shaped portion 30 of the base 22 have a rectangularly shaped catch hole 40 therein. The wall of the tubular portion 32 of the base facing in the same direction as the sidewalls 38 of the box-shaped portion has a rectangularly shaped mounting hole 42, i.e. there are two mounting holes 42 180° apart. Likewise, there is a rectangularly shaped mounting hole 44 in the box-shaped portion adjacent to and continuous with each of the two mounting holes 42, thereby forming a hole that has the appearance of an "L" in cross-section.

Support means for exposed ends 50 of the conductors 14 is provided in the tubular portion 32 of the base 22. The support holds the ends 50 of the conductors away from the surface of the pipe and in close proximity to each other, so that the longitudinal axis of the conductors is oriented substantially radially relative to the pipe. The support means can be a saddle 52 having the appearance of an inverted "V" in cross-section as shown in FIG. 4, with a truncated section 53 at the apex of the inverted "V". The support divides the interior of the box shaped portion of the base into two sections 55, one for each of two conductors.

The insert 24 is deformable, metallic, and electrically conductive. It has at least one aperture adapted to receive the conductors to be connected such as a slot 54 through its circumference in the plane of a diameter, where the slot extends along the entire length of the insert. The slot 54 is sufficiently wide as to accept the uninsulated ends 50 of at least two conductors.

The insert 24 shown in the Figures is adapted for connecting flat conductors in that its aperture is a slot 54. An insert for conductors of different shapes can be accomodated by the connector merely by changing inserts. For example, for connecting round conductors, an insert having at least one cylindrical hole therethrough parallel to or coincident with the axis of the insert suffices. An insert can have different shaped apertures for different shaped conductors. For example, a single insert can have one or more slots and one or more cylindrical holes. An aperture can also be oval, triangular, square, hexagonal, octagonal, etc. in cross-section. The aperture does not have to extend to the circumference of the insert, but instead can be circumferentially enclosed.

The crimp barrel 26 is tubular, deformable and preferably electrically conductive, metallic and made of the same material as the insert 24 is made. The opening 56 through the tubular barrel 26 is sufficiently large that the barrel can fit over the insert 24. Preferably the barrel 26 fits snugly over the insert 24. Too tight a fit results in difficulty in assembly, and too loose a fit can result in slippage during the making of a connection.

The cap 28 is generally tubular having a closed end 60, an open end 62 and two deflectable mounting arms or prongs 64 on the exterior surface and extending beyond the open end 62. The two mounting arms 64 are spaced 180° apart on the cap. Each arm 64 has a lower thickened portion or barb 66 that provides a shoulder 68. The cap 28 is made of a resilient material so that the mounting arms 64 can be deflected. On the interior surface 70 of the cap 28 there are projections such as three parallel, longitudinally extending ribs 72. The cap and the ribs 72 are sized so that the cap can slide over the crimp barrel 26 wherein the ribs, which are equidistantly spaced around the interior circumference of the cap 28, hold the cap substantially centrally located along the longitudinal axis of the barrel. Projections other than the ribs 72 can be used, as long as they are sized and positioned to hold the cap so that the longitudinal axis of the barrel and the longitudinal axis of the cap are substantially colinear when the cap is slid over the barrel. The cap is sufficiently long that it can fit over the entire barrel 26 and insert 24.

To make a splice connection with the connector 20, insulated conductors 14 of the heaters are exposed, and insulation is removed from the end of each conductor. Two conductors 14 are brought into the interior of the base through the entrance holes 35 and each is bent over one leg of the saddle 52 so that the exposed ends 50 of the conductors are up and away from the surface of the pipe and the conductors extend radially relative to the longitudinal axis of the pipe. The base 22 is placed on the pipe. The slot 52 of insert 24 is placed over the ends of the conductors and the crimp barrel 26 is placed over the insert. The barrel is then crimped using a conventional crimp tool, preferably one that is able to exert at least one and one-half tons of force. The deformation of the barrel 26 resulting from the crimp tool is shown in FIG. 3 in a central region 72 of the barrel 26. Because the exposed ends 50 of the connectors are held up and away from the surface of the pipe 10, access to the conductors is easy. This is a significant advantage of this technique compared to splicing techniques where the exposed ends of the conductors are parallel to and adjacent to the surface of the pipe.

The cap 28 and base 30 are filled as much as possible with a sealant such as a viscous, curable resin. The sealant provides an environmental seal for the splice, protecting the splice against moisture and other contaminants. The sealant also is electrically non-conductive. A preferred sealant is room temperature vulcanizing silicone rubber such as Dow Corning 732 black mastic. This material is relatively nonconductive, flows at room temperature, and sets up at room temperature using an acetic acid cure. In a cured state, it is flexible.

The cap containing the sealant is positioned over the base containing the sealant with the mounting arms 64 directly above the mounting holes 44. The cap is slid over the barrel, the barrel and cap producing a "piston" effect to pressure the resin so that it substantially completely fills the cap and the base, leaving no voids for penetration of moisture and other contaminants. Excess sealant flows out from under the base. Because of the truncated portion 53 of the saddle, it is possible to force resin into the region between the saddle and the two conductors 50. It was found that without such a truncated portion, there was a tendency for the sealant to bypass this region, thereby resulting in voids. The cap is pressed down over the barrel until the edge 80 of the cap around the open end 62 of the cap seats against the box-shaped portion 30 of the base 22. The cap is sufficiently large that it fits over the tubular portion 32. The deflectable mounting arms 64 are pressed slightly radially inwardly so that they fit through the mounting holes 44. They then snap back so that the projections 66 extend into the catch holes 40 with the shoulder 68 up against the sidewall 38. This prevents the cap being lifted out of position by the back pressure of the sealant.

Exemplary of the materials which the insert 24 and crimp barrel 26 can be are conductors such as silver, tin, and preferably copper. The base and the cap preferably are made of rigid, strong, electrically-non-conductive material which can be injection molded for low cost production of these components. In addition, preferably the cap and base have resistance to most chemicals carried in pipelines so that in case of a spill, the connecting apparatus is not adversely effected. The same is true of the cured sealant. In addition, the cap needs to be formed of a material that has sufficient flexibility that the mounting arms 64 can be deflected so that they can be inserted through the mounting holes 44. A preferred material is an injection molding grade polysulfone resin such as Udel P-1700 made by Union Carbide. This material has an Underwriters Laboratories electrical rating for continuous service at 140° C.

An advantage of the connector 20 is that it is usable for a large variety of sizes of conductors. Merely by changing the insert 24, and on occasion the crimp barrel 26, conductors of varying thicknesses and width can be accommodated using the same base and cap. In addition, although the connector has been described principally with regard to flat conductors, it is also useful with oval, round, and other shaped conductors, merely by using an insert having a hole therethrough other than a hole in the shape of a slot.

In addition to this interchangeability, this connecting apparatus has other advantages. For example, it can be used not only for splicing two conductors together, but also for terminating conductors. When terminating the heater 12 all three conductors are placed in the insert 24 and then crimped in place.

It has been found that a connection made with the connector 20 using the method described herein provides a connection that is substantially environment proof. Moisture cannot migrate into the connection. Even under severe temperature cycling, the conductors remain spliced together. When subjected to 100 temperature cycles of −40° F. to +400° F., the electrical integrity of the connection is maintained. The connection is moisture proof, and spills of most materials contained in pipelines do not affect the connection. The insert and crimp barrel can provide a gas-tight, metallurgical bond at the interface of the conductor and insert.

Although the present invention has been described in considerable detail with regard to certain versions thereof, other versions are possible. Therefore, the scope of the appended claims should not be limited to the description of the preferred versions contained herein.

What is claimed is:

1. A connector for connecting substantially flat conductors comprising:

(a) a deformable insert having a slot through a circumferential edge and extending along the entire length of the insert, the slot being rectangular in cross-section at all cross-sections and sufficiently wide to accept two such flat conductors; and (b) a deformable crimp barrel shaped to fit around the insert so that when the barrel is crimped, the width of a substantial portion of the slot is decreased to hold the conductors firmly therein.

2. The connector of claim 1 in which the insert is cylindrical.

3. The connector of claim 1 in which the barrel and insert are of substantially the same length.

4. The connector of claim 1 in which the slot is along a diameter of the barrel.

5. An apparatus for splicing a substantially flat conductor of a strip heater mounted on a pipe to a substantially flat conductor of another strip heater mounted on the same pipe comprising:

(a) a base adapted for mounting on the pipe surface, the base having an entrance hole on each of two opposing side walls for the conductors, a cap mounting hole on each of the other opposing side walls, and a saddle adapted for holding the ends of the conductors away from the surface of the pipe and oriented radially relative to the pipe;

(b) a deformable cylindrical insert having a slot through a circumferential edge and along a diameter, the slot extending along the entire length of the insert and being sufficiently wide to accept the ends of the two conductors held radially by the saddle;

(c) a tubular, deformable crimp barrel shaped to fit around the insert so that when the barrel is crimped, the width of a substantial portion of the slot is decreased to hold the conductors firmly therein; and (d) a cap slidable over the barrel and comprising an open end adapted to seat against the base, a closed end, deflectable mounting arms for engaging the cap mounting holes, and internal ribs projecting inwardly a sufficient amount such that when the cap is slid over the barrel, the longitudinal axis of the barrel and the longitudinal axis of the cap are maintained substantially colinear so the sliding action can pressure viscous fluid present in the cap substantially uniformly to completely fill the cap and the base.

6. The apparatus of claim 5 in which the saddle is truncated adjacent to the conductors to provide a path for viscous fluid to pass beneath the conductors.

7. The apparatus of claim 5 in which the slot is rectangular in cross-section.

8. An apparatus for electrically connecting a conductor comprising:

(a) a base having entrance means for the conductor;

(b) a crimp barrel for holding the end of the conductor; and (c) a cap slidable over the barrel comprising an open end adapted to seat against the base, a closed end, and internal projections extending inwardly a sufficient amount such that when the cap is slid over the barrel, the sliding action can pressure viscous fluid present in the cap substantially uniformly to completely fill the cap and the base.

9. The apparatus of claim 8 in which the projections are ribs extending parallel to the longitudinal axis of the cap.

10. The apparatus of claim 9 wherein the cap has at least three ribs which are spaced substantially equidistant apart.

11. The apparatus of claim 8 in which the barrel is tubular.

12. The apparatus of claim 8 including a cylindrical insert that fits within the barrel, the insert having a slot through a circumferential edge, the slot extending along the entire length of the insert and being sufficiently wide to accept the conductor, wherein deformation of the crimp barrel causes the width of a substantial portion of the slot to be decreased.

13. The apparatus of claim 8 including means for securing the cap to the base in a selected position.

14. An apparatus for electrically connecting a conductor comprising:

(a) a base adapted for mounting on a support surface, the base having entrance means for the conductor, and support means for holding the conductor away from the support surface and oriented perpendicular relative to the support surface;

(b) a deformable insert having an aperture adapted to receive the conductor;

(c) a deformable crimp barrel shaped to fit around the insert so that when the barrel is crimped, the width of a substantial portion of the aperture is decreased to hold the conductor firmly therein; and (d) a cap slidable over the barrel comprising an open end adapted to seat against the base, a closed end, means for securing the cap to the base, and internal ribs projecting inwardly a sufficient amount such that when the cap is slid over the barrel, the longitudinal axis of the barrel and the longitudinal axis of the cap are maintained substantially colinear so the sliding action can pressure viscous fluid present in the cap substantially uniformly to completely fill the cap and the base.

15. A splice connection comprising at least two substantially flat conductors held firmly within a deformed insert having a slot through a circumferential edge and extending along the entire length of the insert, a substantial portion of the slot being sufficiently deformed to hold the conductors firmly therein, the slot before such deformation being substantially rectangular in cross-section and sufficiently wide to accomodate the conductors, and a crimp barrel shaped to fit around the insert and deformed in the region overlying the region of the insert that is deformed, there being a gas-tight, metallurgical bond at the interface of the conductors and the insert.

16. The connection of claim 15 in which the barrel and the insert are of substantially the same length.

17. The connection of claim 15 in which the slot is along a diameter of the barrel.

18. A splice connection comprising:

(a) the ends of two substantially flat conductors of two strip heaters;

(b) a deformed cylindrical insert having a slot through a circumferential edge and along the entire length of the insert, the conductors being firmly held together in the slot of the insert away from a support surface and oriented perpendicular relative to the support surface, the slot being substantially rectangular in cross section and sufficiently wide before deformation of the insert to have the conductors inserted therein;

(c) a deformed, tubular crimp barrel around the insert and deformed in the region of the barrel overlying the region of the insert that is deformed;

(d) a base mounted on the support surface, the base having an entrance hole on each of the two opposing side walls through which a conductor extends, the base comprising a cap mounting pole on each of the other opposing side walls, and a saddle for supporting the conductors;

(e) a cap mounted over the barrel and comprising an open end seated against the base, a closed end, deflectable mounting arms engaging the cap mounting holes of the base, and internal ribs projecting inwardly a sufficient amount so that the longitudinal axis of the barrel and the longitudinal axis of the cap are substantially colinear; and (f) a water resistant, electrically non-conductive sealant substantially completely filling the cap and the base.

19. The splice connection of claim 18 wherein the saddle is truncated adjacent to the conductors.

20. A splice connection comprising:

(a) a conductor;

(b) a crimp barrel holding the conductor;

(c) a base mounted on a support surface;

(d) a cap mounted over the barrel and comprising an open end seated against the base, a closed end, and internal projections extending inwardly a sufficient amount that the longitudinal axis of the barrel and the longitudinal axis of the cap are substantially colinear; and (e) a water resistant, electrically non-conductive sealant substantially completely filling the cap and the base.

21. The splice connection of claim 20 including means for securing the cap to the base.

22. A method for electrically connecting a substantially flat conductor comprising the steps of:

(a) placing the conductor in a deformable insert having a slot through a circumferential edge and extending along the entire length of the insert, the slot being rectangular in cross-section, the conductor being placed in the slot of the deformable insert;

(b) placing a deformable crimp barrel around the insert; and (c) deforming the crimp barrel with sufficient force that the insert is deformed and a substantial portion of the width of the slot is decreased to hold the conductor firmly therein.

23. A method for splicing a substantially flat conductor of a strip heater mounted on a pipe to a substantially flat conductor of another strip heater mounted on the same pipe comprising the steps of:

(a) selecting an apparatus comprising (i) a base adapted for mounting on the pipe surface, the base having an entrance hole on each of two opposing side walls for the conductors, a cap mounting hole on each of the other opposing side walls, and a saddle adapted for holding the ends of the conductors away from the surface of the pipe and oriented radially relative to the pipe;

(ii) a deformable cylindrical insert having a slot through a circumferential edge and along a diameter, the slot extending along the entire length of the insert and being sufficiently wide to accept the ends of the two conductors held radially by the saddle;

(iii) a tubular, deformable crimp barrel shaped to fit around the insert so that when the barrel is crimped, the width of a substantial portion of the slot is decreased to hold the conductors firmly therein; and (iv) a cap slidable over the barrel and comprising an open end adapted to seat against the base, a closed end, deflectable mounting arms for engaging the cap mounting holes, and internal ribs projecting inwardly a sufficient amount such that when the cap is slid over the barrel, the longitudinal axis of the barrel and the longitudinal axis of the cap are maintained substantially colinear so the sliding action can pressure viscous fluid present in the cap substantially uniformly to completely fill the cap and the base;

(b) mounting the base of the apparatus on the pipe surface;

(c) inserting each of the conductors through one of the entrance holes of the base and bending the ends of the conductors so that they are supported by the saddle of the base away from the surface of the pipe and oriented radially relative to the pipe;

(d) placing the ends of each of the conductors in the slot of the insert;

(e) placing the crimp barrel around the insert;

(f) deforming the crimp barrel a sufficient amount that the insert is also deformed so a substantial portion of the cross-section of the slot is decreased to hold the conductors firmly therein;

(g) placing sealant in the cap base;

(h) sliding the cap over the barrel a sufficient amount that the deflectable mounting arms engage the cap mounting holes of the base, the cap being slid with the longitudinal axis of the cap being substantially colinear with the longitudinal axis of the crimp barrel, the sliding action pressuring sealant present in the cap substantially uniformly to substantially completely fill the cap and the base; and (i) permitting the sealant to cure with the cap held in position relative to the base by the mounting arms.

24. A method for electrically connecting a conductor comprising the steps of:

(a) selecting an apparatus comprising (i) a base having entrance means for the conductor;

(ii) a crimp barrel for holding the end of the conductor; and (iii) a cap slidable over the barrel comprising an open end adapted to seat against the base, a closed end, and internal projections extending inwardly a sufficient amount such that when the cap is slid over the barrel, the sliding action can pressure viscous fluid present in the cap substantially uniformly to completely fill the cap and the base;

(b) mounting the base of the apparatus on a support surface;

(c) inserting the conductor through entrance means of the base;

(d) placing the conductor in the crimp barrel;

(e) deforming the crimp barrel a sufficient amount to hold the conductor therein;

(f) placing sealant in the cap and base; and (g) sliding the cap over the barrel, the cap being slid with the longitudinal axis of the barrel and the longitudinal axis of the cap being substantially colinear, the sliding action pressuring sealant present in the caps substantially uniformly to substantially completely fill the cap and the base.

25. The method of claim 22 in which the slot is sufficiently wide to accept two such substantially flat conductors.

26. A method for connecting a substantially flat conductor comprising the steps of:

(a) selecting a connector comprising:

(i) a deformable insert having a slot through a circumferential edge and extending along the entire length of the insert, the slot being rectangular in cross-section; and (ii) a deformable crimp barrel shaped to fit around the insert so that when the barrel is crimped, the width of a substantial portion of the slot is decreased to hold the conductors firmly therein;

(b) placing the conductor in the slot of the deformable insert;

(c) placing the deformable crimp barrel around the insert; and (d) deforming the crimp barrel with sufficient force that the insert is deformed and a substantial portion of the width of the slot is decreased to hold the conductor firmly therein for forming a gas-tight, metallurgical bond at the interface of the conductor and the insert.

27. The method of claim 23 in which the crimp barrel is deformed with sufficient force that a gas-tight, metallurgical bond is formed at the interface of the conductor and the insert.

* * * * *